US006934502B2

(12) United States Patent
Okuda

(10) Patent No.: US 6,934,502 B2
(45) Date of Patent: Aug. 23, 2005

(54) IMAGE FORMATION APPARATUS

(75) Inventor: Tatsuo Okuda, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 60 days.

(21) Appl. No.: 10/458,229

(22) Filed: Jun. 11, 2003

(65) Prior Publication Data

US 2003/0228168 A1 Dec. 11, 2003

(30) Foreign Application Priority Data

Jun. 11, 2002 (JP) ..... 2002-169510

(51) Int. Cl.[7] ..... G03G 15/00
(52) U.S. Cl. ..... 399/379; 399/81; 345/905
(58) Field of Search ..... 399/13, 31, 81, 399/107, 110, 114, 144, 379–380; 355/133; 358/305; 235/145 R; 345/840, 961, 905, 700, 716, 866, 168, 520, 940

(56) References Cited

U.S. PATENT DOCUMENTS 3,936,182 A * 2/1976 Sheikh ..... 399/77
4,279,199 A * 7/1981 Blanco et al. ..... 101/93.05
4,305,653 A * 12/1981 Evanitsky ..... 399/32
4,460,269 A * 7/1984 Yamazaki et al. ..... 399/23
4,472,050 A * 9/1984 Stockburger et al. ..... 355/40
4,632,585 A * 12/1986 Oyamatsu et al. ..... 400/613
5,038,169 A * 8/1991 Marincie et al. ..... 399/124
5,140,438 A * 8/1992 Kurahashi et al. ..... 358/401
5,182,796 A * 1/1993 Shibayama et al. ..... 345/841
5,198,909 A * 3/1993 Ogiwara ..... 358/412
6,091,915 A * 7/2000 Takagishi ..... 399/81
6,725,001 B2 * 4/2004 Takahashi et al. ..... 399/81
2002/0191980 A1 * 12/2002 Kuda ..... 399/81
2003/0231367 A1 * 12/2003 Quintana ..... 358/527

* cited by examiner

*Primary Examiner*—Eugene H. Eickholt
(74) *Attorney, Agent, or Firm*—Oblon, Spivak, McClelland, Maier & Neustadt, P.C.

(57) ABSTRACT

An image formation apparatus includes a console that has a display consisting of a liquid crystal display, a start key, and ten keys. The console is integrated on the front side of a platen that is mounted on a main body of the image formation apparatus. The upper surface of the console is inclined.

8 Claims, 3 Drawing Sheets

IMAGE FORMATION APPARATUS

BACKGROUND OF THE INVENTION

1. Field of the Invention

The present invention relates to an image formation apparatus that reads images, such as a copier, a facsimile, a scanner, and a multi-function device that is a complex integration of those functions.

2. Description of the Related Art

FIG. 1 is a perspective view of a conventional image formation apparatus. The conventional image formation apparatus constitutes a main body 1, a paper feeder 2, a platen 3 into which an automatic document feeder is integrated. The main body 1 is equipped with an imaging section, a fixing section, a paper ejecting section 4, and a document table (i.e., a contact glass) on which original documents to be read are placed. The imaging section has an image reader, a photoconductor, and a developer. The fixing section has a mechanism to fix an image onto a paper, not shown in the drawing. The document table is arranged on the upper surface of the main body 1. The image reader reads the original document put between the plate 3 and the document table.

This image formation apparatus also has a console 5. The console 5 is provided on the upper front side of the main body 1 with an upper surface thereof inclined. The console also has a display 6 (e.g., a liquid crystal display), a start key 7, and ten keys not shown. An operator, through the console 5, instructs the image formation apparatus on procedures for imaging, image transfer, and the like, and then visually confirms the procedures. The operator stands in front of the main body 1 to manipulate the console 5. Since the operator looks down at the display 6, the operator can carry out the manipulation easily, and can visually confirm the display contents.

However, as shown in FIG. 2, when a large-sized document 8 (e.g., a map or a poster) is placed on the document table, a part of the large-sized document 8 is out of the area of the document table. As a result, such a position of the console 5 causes the part of the large-sized document 8 to hide the console 5. Therefore, the operator needs to lift the part which hides the console 5 to confirm information in the display 6. Such a lift work makes the operator take time, and thus the operator requires an image formation apparatus that is free of the work.

SUMMARY OF THE INVENTION

It is an object of the present invention to at least solve the problems in the conventional technology.

The image formation apparatus according to one aspect of the present invention includes a document table on which a document to be read is placed; a platen that covers the document placed on the document table; and a console to input instructions to control the image formation apparatus and display information, wherein the console is arranged at a position where the console is visible even when the document is placed on the document table.

The image formation apparatus according to another aspect of the present invention includes a console to input instructions to control the image formation apparatus and display information, wherein the console is arranged to rotate along an axis.

The image formation apparatus according to still another aspect of the present invention includes a console that has operation panel having keys to input instructions to control the image formation apparatus and a display to display information, wherein any one of the display and the operation panel is arranged to rotate along an axis.

The other objects, features and advantages of the present invention are specifically set forth in or will become apparent from the following detailed descriptions of the invention when read in conjunction with the accompanying drawings.

DETAILED DESCRIPTION

Figure 1:
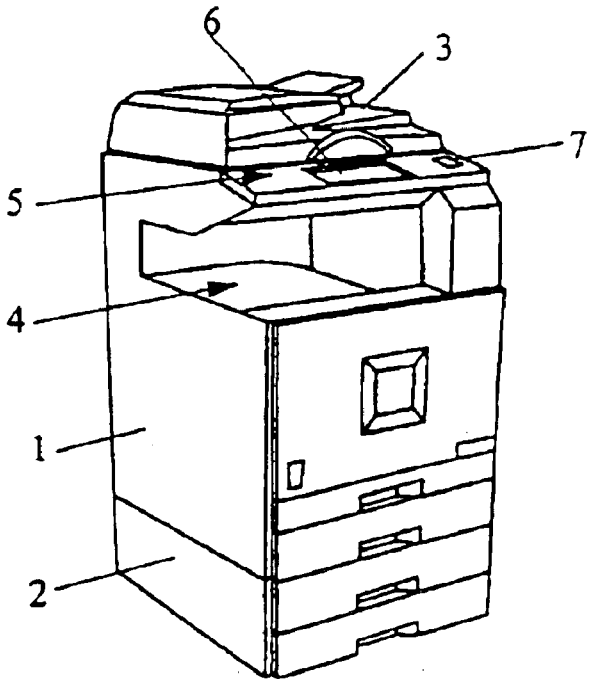
FIG.1 BACKGROUND ART
FIG. 1 is a perspective view of the whole structure of a conventional image formation apparatus.
Figure 2:
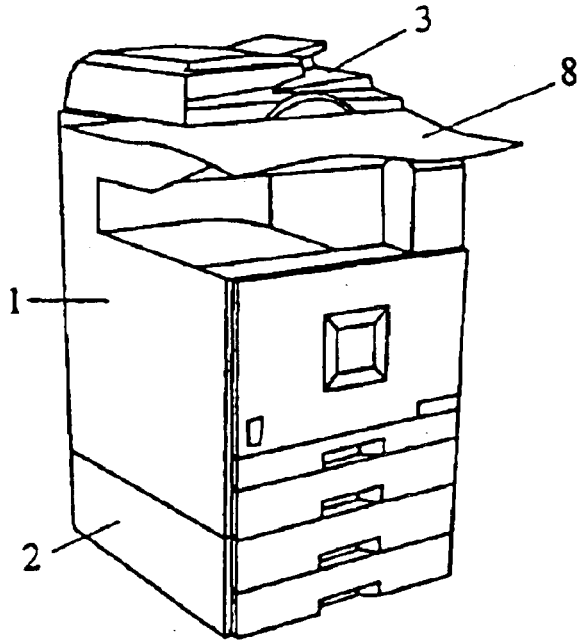
FIG.2 BACKGROUND ART
FIG. 2 is a perspective view of the conventional image formation apparatus with the console hidden.

Exemplary embodiments of the image formation apparatus relating to the present invention will be explained in detail below with reference to the accompanying drawings. Like reference numerals designate corresponding parts in the several views.

Figure 3:
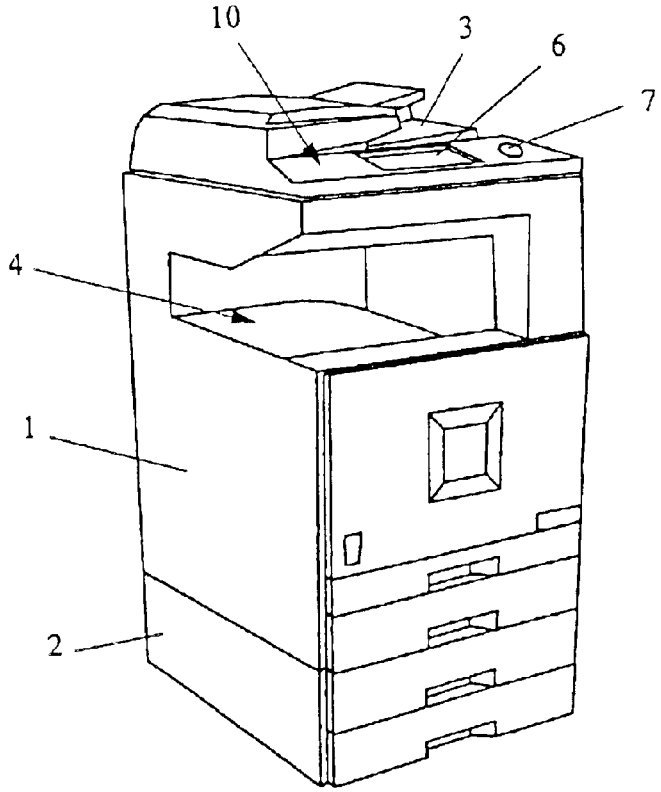
FIG. 3 is a perspective view of an image formation apparatus of a first embodiment according to the present invention.

FIG. 3 is a perspective view of an image formation apparatus of a first embodiment according to the present invention. This image formation apparatus differs from the conventional image formation apparatus in that a console 10 is integrated into the platen 3 at the front side of the platen 3. The plate 3 may be integrated into an automatic document feeder or an automatic reverse document feeder. The console 10 has its upper surface inclined like in the conventional image formation apparatus. The console also includes the display 6 consisting of a liquid crystal display, the start key 7, and the ten keys. The operator, when standing in front of the main body 1 to manipulate the console 10, looks down at the display 6. Therefore, the operator can manipulate the console 10 easily and can visually confirm the display contents of the display 6.

Figure 4:
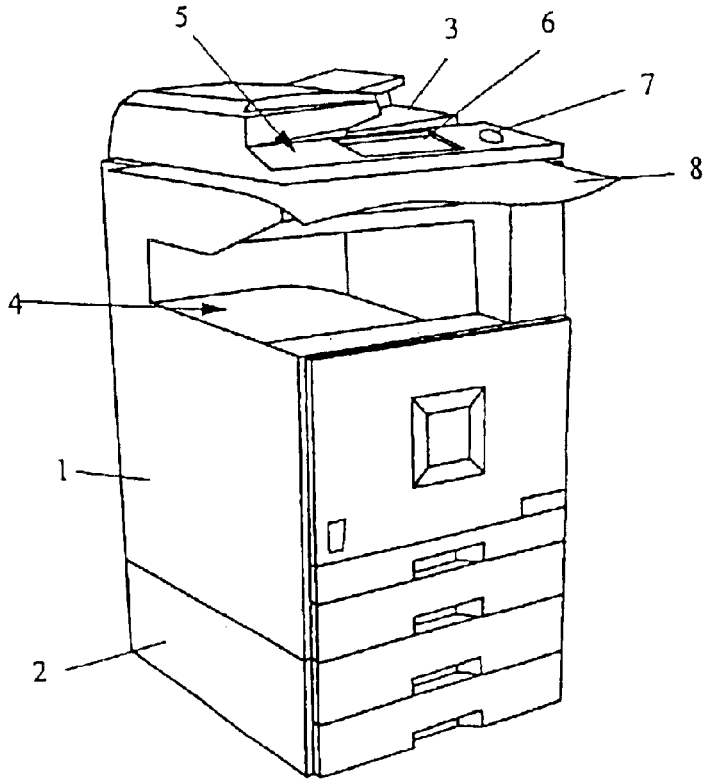
FIG. 4 is a perspective view of the image formation apparatus in state that a large-sized document is placed.

Even when the large-sized document 8 is placed on the document table and a part of the large-sized document 8 is out of the area of the document table, the console 10 is not covered with the large-sized document 8. This is because the console 10 is positioned above the large-sized document 8, like the platen 3, as shown FIG. 4.

As a result, the operator can visually confirm the display contents of the display 6 and give instructions on the image formation apparatus through the console 10 without lifting the part of large-sized document 8.

Figure 5:
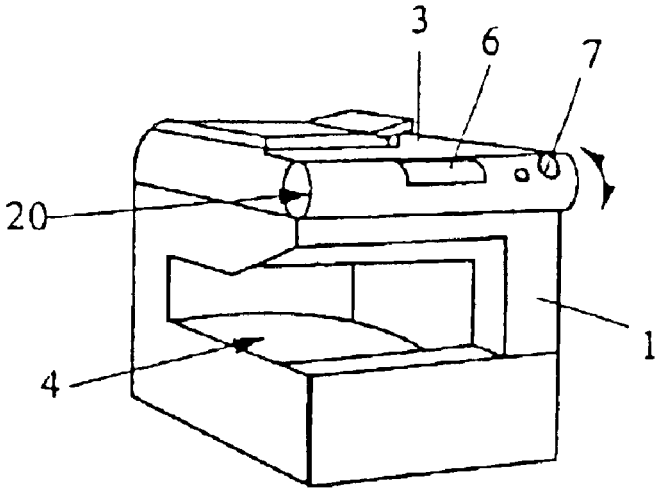
FIG. 5 is a perspective view of an image formation apparatus of a second embodiment according to the present invention.

FIG. 5 is a perspective view of an image formation apparatus of a second embodiment according to the present invention. This image formation apparatus is similar to that of the first embodiment in that a console 20 is provided at the front side of the platen 3. In this image formation apparatus, the console 20 is a separate unit from the platen 3 and is supported with the platen 3 to rotate vertically.

Figure 6:
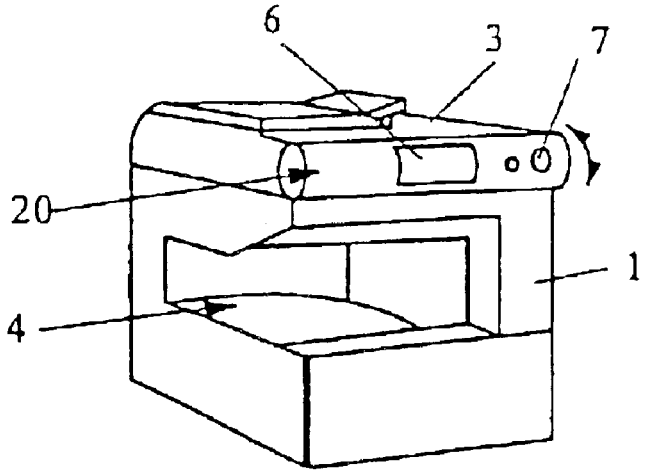
FIG. 6 is a perspective view of the image formation apparatus in a state that the console has rotated.

The image formation apparatus having a small height as shown in FIG. 5 is installed at a high position like on a desk, and thus the position is too high for the operator to operate the console 20, in some cases. The console 20 according to the second embodiment is useful for such an image formation apparatus. For example, as shown in FIG. 6, the console 20 is rotated downward from a state shown in FIG. 5, thereby to set the surface of the console 20 vertical or approximately vertical. This vertical console 20 makes some operators manipulate more easily. Even when the image formation apparatus is disposed on a desk or on a cabinet at the side of a desk, the operator can manipulate the console 20, without depending on whether standing or sitting.

An image formation apparatus having a relatively large height like in the first embodiment may include the console 20 in place of the console 10. The display 6 only or the console 20 may be formed in a panel shape and be rotatably supported at the platen 3.

As explained above, according to an aspect of the present invention, the image formation apparatus has the operation panel that displays the manipulation contents and the operation contents, on the platen that is provided on the main body. Therefore, even when a part of a large-sized document is out of the area of the document table, the part does not hide the console. As a result, the operator can manipulate the console without lifting the part of the large-sized document.

According to another aspect of the present invention, the image formation apparatus has a direction of the console or a part of the console supported movably. Therefore, it is possible to change the direction of the console surface according to a set position or a height of the image formation apparatus. As a result, the operator can manipulate the console easily without depending on a vertical position of the console.

The present document incorporates by reference the entire contents of Japanese priority document, 2002-169510 filed in Japan on Jun. 11, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation apparatus, comprising:

a document table configured to receive a document to be read;

a platen configured to cover the document to be read on the document table; and a console configured to input instructions to control the image formation and to display information, the console integrated into a front side of the platen and visible even when the document is placed on the document table.

2. The image formation apparatus according to claim 1, wherein the platen is integrated into an automatic document feeder.

3. An image formation apparatus, comprising:

a document table configured to receive a document to be read; and a platen configured to cover the document to be read on the document table; and a console configured to input instructions to control the image formation apparatus and to display information, the console integrated into the platen and configured to rotate along an axis.

4. The image formation apparatus according to claim 3, wherein the platen is integrated into an automatic document feeder.

5. The image formation apparatus according to claim 3, wherein the axis is parallel to the ground.

6. An image formation apparatus, comprising:

a document table configured to receive a document to be read; and a platen configured to cover the document to be read on the document table;

a console including an operation panel configured to input instructions to control the image formation apparatus and a display configured to display information, the console integrated into the platen and any one of the display and the operation panel configured to rotate along an axis.

7. The image formation apparatus according to claim 6, wherein the platen is integrated into an automatic document feeder.

8. The image formation apparatus according to claim 6, wherein the axis is parallel to the ground.

* * * * *